United States Patent [19]

Kupersmit

[11] 4,405,077

[45] Sep. 20, 1983

[54] COLLAPSIBLE TALL CONTAINER

[76] Inventor: Julius B. Kupersmit, 229 W. 12th St., New York, N.Y. 10014

[21] Appl. No.: 320,328

[22] Filed: Nov. 12, 1981

[51] Int. Cl.[3] ..... B65D 5/36

[52] U.S. Cl. ..... 229/41 R

[58] Field of Search ..... 229/41 R, 41 B, 23 A, 229/23 R; 108/51.3, 53.1, 56.1

[56] References Cited

U.S. PATENT DOCUMENTS

| | | | |
|---|---|---|---|
| 734,449 | 7/1903 | Van Warmer | 229/41 R |
| 1,921,946 | 8/1933 | Rudowitz | 229/41 R |
| 2,791,367 | 5/1957 | Mefford | 229/41 R |
| 4,252,266 | 2/1981 | Kupersmit | 229/23 R |

FOREIGN PATENT DOCUMENTS

| | | | |
|---|---|---|---|
| 444114 | 7/1912 | France | 229/41 R |

*Primary Examiner*—Herbert F. Ross
*Attorney, Agent, or Firm*—Charles E. Temko

[57] ABSTRACT

A large size shipping container of a type which may be conveniently collapsed after use for return to a shipping source for reuse. In lieu of the usual wood or plastic pallet which forms a base for the container, a solid or corrugated fiber sheet is provided, the free edges of which extend outwardly of the container to provide means for forklift engagement. The container is substantially taller than any horizontal dimension, and a novel construction for folding the side walls is disclosed.

2 Claims, 6 Drawing Figures

COLLAPSIBLE TALL CONTAINER

BACKGROUND OF THE INVENTION

This invention relates generally to the field of collapsible reusable shipping containers of the type described in my prior U.S. Pat. No. 3,443,737 of Apr. 13, 1969, and a more recent U.S. Pat. No. 4,252,226 of Feb. 6, 1981. More particularly it relates to an improved form thereof.

Such shipping containers are used principally for air and truck transport, where space and weight considerations are of substantially greater importance than the cost of fabrication, particularly when the container may be reused as many as one half dozen times before it becomes so worn that it must be discarded. However, in recent years, the cost of manufacture has increased substantially, and is now a factor of more than nominal importance.

In the abovementioned U.S. Pat. No. 4,252,226, there is disclosed a collapsible container with a simplified cardboard pallet which costs less to manufacture and requires less space when stored. My copending application, Ser. No. 06/257,127, filed Apr. 24, 1981, (now U.S. Pat. No. 4,358,049) describes an improvement over this container in the provision of a reinforced base particularly suited for resisting outwardly directed forces caused by fluid or particulate loads.

However, all of the abovementioned constructions require, for convenience in folding, a side wall height which is no greater than one half the horizontal length of the longer side walls of the container when in erected condition. This restriction permits the use of a scored fold line disposed at approximately forty five degrees to the horizontal, commencing at one corner of each side wall, which, when folded, places the end walls in approximately abutted condition without overlapping, and permits the still erected lid or cover to neatly overlie and protect the side and end walls of the body of the container during the return shipment thereof.

There are, however, many occasions in which it is desirable to provide a collapsible container of the instant type in which the height thereof is substantially greater than one half the length, due to such considerations as the configuration of the article to be shipped, the configuration of the shipping vehicle, convenience in loading and the like. While it is always possible to design a carton with side walls of desired proportions, convenience in folding without the necessity of disconnecting one wall from another, not only reduces labor, but enhances the useful life of the container as well.

SUMMARY OF THE INVENTION

Briefly stated, the invention contemplates the provision of an improved collapsible shipping container of the class described in which the side and end walls thereof may be considerably higher than one half the length of the side walls, while maintaining the ability to be folded to substantially planar condition without the necessity of disconnecting any of the side or end walls from the bottom wall or from each other; and without the necessity of any breaking in the continuity of the side and end walls. In essence, this advantage is provided by resort to the use of plural scored angularly disposed fold lines known in the prior art with the provision of an additional second fold line in one of the side walls which interconnects the upper end of a forty five degree fold line and a horizontally opposite corner on the same wall. This permits the folding of the related side and end walls by temporarily shortening the effective width of the side wall. Once the side wall is folded to horizontal position, the triangularly shaped area previously folded out of the plane of the side wall is restored, and the remaining oppositely disposed end wall, oppositely disposed side wall, and adjacent side wall are then serially folded to planar condition. To protect the extensions of the base element, they are folded to vertical condition wherein the free edges thereof define a height approximating that of the folded side walls so as to be disposed beneath the still erected cover element for return shipment. No tools are required to effect collapse, and reerection of the carton for reloading merely requires a reversal of the steps employed during the collapsing operation.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
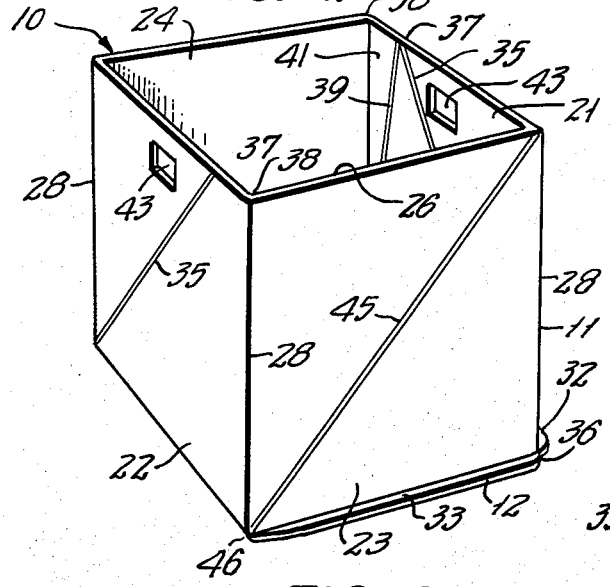
FIG. 1 is a side elevational view of an embodiment of the invention, with certain of the component parts removed for purposes of clarity.
Figure 4:
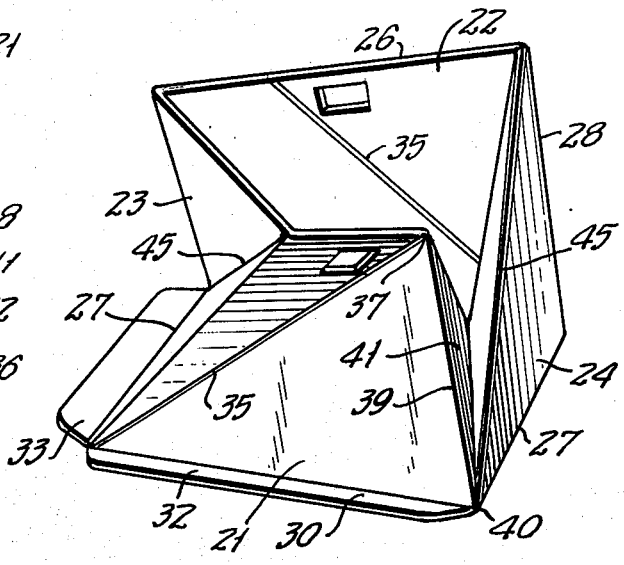
FIG. 4 is a side elevational view, showing a subsequent stage of folding.

In accordance with the invention, the device, generally indicated by reference character 10, comprises broadly: a box element 11 and a base element 12.

The box element 11 may be formed from a single blank of corrugated material, as is known in the art, and includes a bottom wall (not shown) formed of four overlapped flaps. In the alternative, the flaps may be eliminated and short gluing extensions may be provided in lieu thereof, as taught in my abovementioned copending application Ser. No. 06/257,127 (now U.S. Pat. No. 4,358,049).

Interconnected to the bottom wall 15 are first and second side walls 21 and 22, respectively, and first and second end walls 23 and 24, respectively. A gluing flap 25 is provided at a vertical edge of one of the above walls which form a continuous upper edge 26 and a continuous lower edge 27 communicating with vertically disposed corner fold lines 28.

The base element 12 may be formed similarly to that disclosed in the abovementioned copending application, and includes a horizontal wall 31 having a side extension 32 and an end extension 33 for convenience in engaging a forklift. When folded to vertical orientation, the extensions 32 and 33 have an effective height corresponding to that of the collapsed box element 11, as will more fully appear hereinafter.

Each of the side walls 22 and 23 includes a first fold line 35 commencing at a lower left hand corner 36, and extending to a point 37 on a corresponding upper edge, spaced a short distance from the diagonally opposite corner 38. In the case of the first side wall 21 only, a second fold line 39 is provided which commences at the point 37 and extends to the lower right hand corner 40 to form a small triangularly shaped wall section 41. Both the first and second side walls 21 and 22 may be provided with aligned rectangular openings 43 to permit the usual flanged cover (not shown) to be secured in sealed relation.

The first and second end walls 23 and 24 are provided with a single diagonal fold line 45 which extends from a lower left hand corner 46 to an upper right hand corner 47. For convenience in folding, the end walls are preferably of square configuration.

Figure 2:
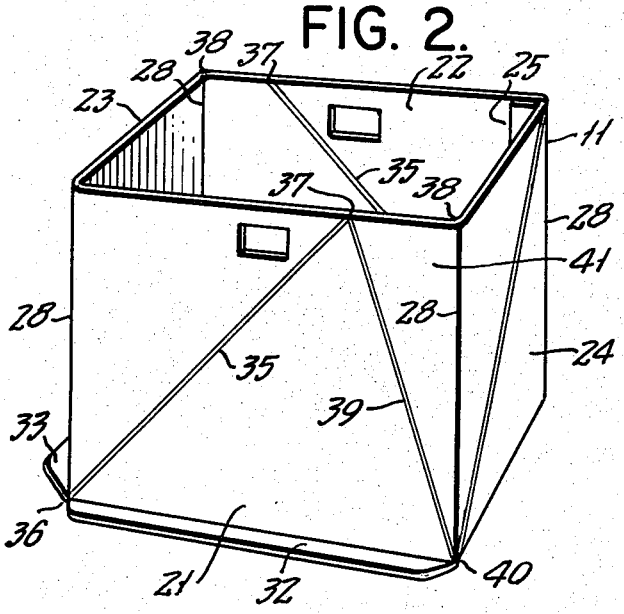
FIG. 2 is a side elevational view thereof.
Figure 5:
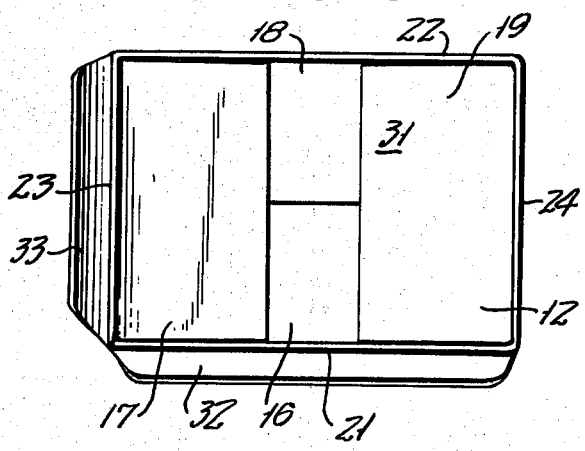
FIG. 5 is a top plan view thereof, showing the embodiment in erected condition.
Figure 3:
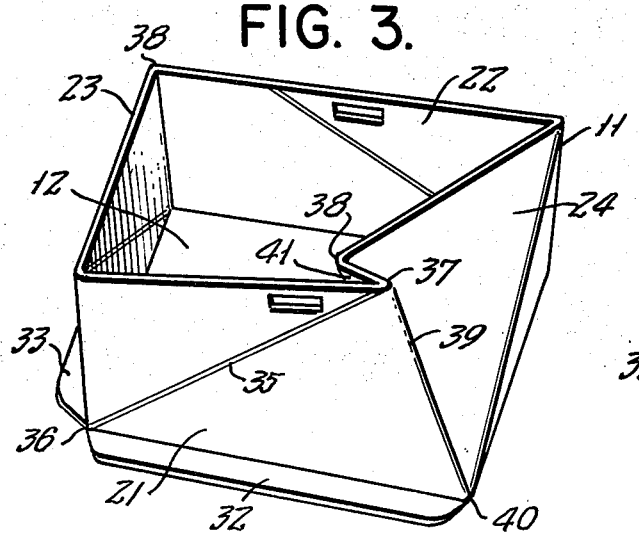
FIG. 3 is a second end elevational view, showing a first step in the collapsing of the embodiment to folded condition.
Figure 6:
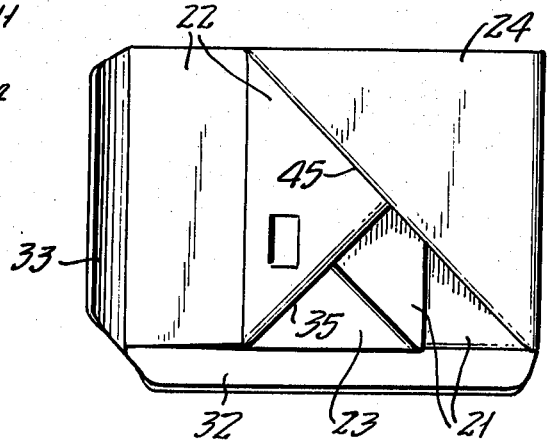
FIG. 6 is a top plan view thereof, showing a final stage of collapse.

To fold the side walls from the erected condition shown in FIG. 1 to the flattened condition shown in FIG. 6, it is necessary to press inwardly at the corner interconnecting the first side wall 21 with the adjacent end wall 23. This will result in the diagonal folding of the end wall, and the folding of the triangular section 41 inwardly, followed by the inward folding about the first fold line of the first side wall as shown in FIG. 2. This action effectively temporarily shortens the width of the first side wall, and enables it to clear the still erect portion of the first end wall until the folded upper portion of the first end wall overlies the still erected second lower portion of the first end wall. At this point, the triangular section 41 begins to return to coplanar position with the adjacent portion of the first side wall 21, and the start of accordion folds with the oppositely disposed end wall 24 and the second side wall 22 has already occurred. Each of these walls is then progressively moved to flattened condition, followed by the flattening of the still erect portion of the first end wall 23. FIG. 6 illustrates the relative position of each of the side and end walls in completely folded condition.

At this point, the side and end extensions 32 and 33 of the base element 12 may be folded upwardly to vertical position, at which point the free edges thereof lie approximately coplanar with the upper surface of the folded side and end walls. They are retained in this position by the placing of the usual flanged cover (not shown) thereover.

To reerect the device 10, it is necessary only to remove the cover, and grasp a portion of the upper edge 26 of the second side wall 22, following which the abovedescribed steps are performed in reverse order.

It will be readily understood that although the above construction results in a container, the height of which is more than half the horizontal length of the longer side walls, a limit with respect to height will be reached at the point where the height is equal to the width of the side walls. At this point, the first and second fold lines of the first side wall will be of approximately equal length, and the abovedescribed operation will not be possible past that point.

I wish it to be understood that I do not consider the invention limited to the precise details of structure shown and set forth in this specification, for obvious modifications will occur to those skilled in the art to which the invention pertains.

I claim:

1. An improved collapsible shipping container comprising: an open topped box-like element having a bottom wall, first and second oppositely disposed side walls, and first and second oppositely disposed end walls, each having a lower edge interconnected to a corresponding edge of said bottom wall; said side and end walls having an effective height substantially greater than half the horizontal length of said side walls, said side walls and end walls being interconnected to each other at vertical side edges thereof; each of said end walls having an angularly disposed fold line commencing at a lower corner thereof and extending to an upper diagonally disposed corner thereof; each of said side walls having a second angularly disposed fold line commencing at a lower corner and extending to an upper edge thereof and terminating a distance from the diagonally opposite corner thereof; one of said side walls having a third fold line commencing from the point of meeting of said second fold line with said upper edge of said wall, and extending downwardly to the corner of said side wall horizontally opposite the corresponding lower corner of said wall; whereby said side walls may be folded upon an upwardly facing surface of said bottom wall by first pushing inwardly at an upper corner of said one of said walls adjacent said second fold line to temporarily effectively shorten the width of said one of said side walls to enable it to clear the adjacent end wall, and permit, without interference, the progressive folding of the oppositely disposed end and side walls, and the adjacent end wall.

2. The construction set forth in claim 1, further comprising a base element forming a pallet having foldable extensions extending laterally from at least one of said side and end walls, said extensions being folded to vertical position to have an effective height corresponding to that of said folded side walls.

* * * * *